US009402142B2

(12) United States Patent
Solum et al.

(10) Patent No.: US 9,402,142 B2
(45) **Date of Patent: *Jul. 26, 2016**

(54) RANGE CONTROL FOR WIRELESS HEARING ASSISTANCE DEVICE SYSTEMS

(71) Applicant: Starkey Laboratories, Inc., Eden Prairie, MN (US)

(72) Inventors: Jeffrey Paul Solum, Shorewood, MN (US); Edward John Cunningham, Savage, MN (US)

(73) Assignee: Starkey Laboratories, Inc., Eden Prarie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/462,010

(22) Filed: Aug. 18, 2014

(65) Prior Publication Data

US 2015/0036855 A1 Feb. 5, 2015

Related U.S. Application Data

(63) Continuation of application No. 13/084,988, filed on Apr. 12, 2011, now Pat. No. 8,811,639.

(60) Provisional application No. 61/323,560, filed on Apr. 13, 2010.

(51) Int. Cl.
*H04R 25/00* (2006.01)

(52) U.S. Cl.
CPC ..... *H04R 25/554* (2013.01); *H04R 25/558* (2013.01); *H04R 2225/55* (2013.01)

(58) Field of Classification Search
CPC . H04R 25/554; H04R 25/558; H04R 2225/55
USPC ..... 381/312–331
See application file for complete search history.

(56) References Cited

U.S. PATENT DOCUMENTS 5,083,312 A 1/1992 Newton et al.
5,768,397 A 6/1998 Fazio (Continued)

FOREIGN PATENT DOCUMENTS

CN 1191060 A 8/1998
EP 1185138 A2 3/2002

(Continued)

OTHER PUBLICATIONS

"U.S. Appl. No. 11/447,617, Final Office Action mailed Mar. 3, 2010", 31 pgs.

(Continued)

*Primary Examiner* — Davetta W Goins
*Assistant Examiner* — Oyesola C Ojo
(74) *Attorney, Agent, or Firm* — Schwegman Lundberg & Woessner, P.A.

(57) ABSTRACT

Disclosed herein, among other things, are apparatus and methods for wireless hearing assistance devices and in particular to a controllable range control for wireless hearing assistance device systems. An advertisement is used to allow the receiver to quickly receive streaming information, thus conserving power. In various embodiments, a system for communications with a hearing assistance device includes a wireless streaming device having a range control. The range control is configured to provide a first range for an advertisement transmission and a second range for a streaming information transmission. The first range is less than the second range, in various embodiments.

16 Claims, 3 Drawing Sheets

(56) References Cited

U.S. PATENT DOCUMENTS

| | | | | |
|---|---|---|---|---|
| 5,966,639 | A | 10/1999 | Goldberg et al. | |
| 6,067,445 | A | 5/2000 | Gray et al. | |
| 6,088,339 | A | 7/2000 | Meyer | |
| 6,438,245 | B1 | 8/2002 | Taenzer et al. | |
| 6,633,645 | B2 | 10/2003 | Bren et al. | |
| 6,694,034 | B2 | 2/2004 | Julstrom et al. | |
| 6,760,457 | B1 | 7/2004 | Bren et al. | |
| 7,062,223 | B2 | 6/2006 | Gerber et al. | |
| 7,075,903 | B1 | 7/2006 | Solum | |
| 7,412,294 | B1 | 8/2008 | Woolfork | |
| 7,433,435 | B2 | 10/2008 | Nagaraja | |
| 7,529,565 | B2 | 5/2009 | Hilpisch et al. | |
| 7,596,237 | B1 * | 9/2009 | Constantin | H04R 25/552 318/2 |
| 7,702,121 | B2 | 4/2010 | Husung et al. | |
| 7,778,432 | B2 | 8/2010 | Larsen | |
| 8,169,938 | B2 | 5/2012 | Duchscher et al. | |
| 8,194,901 | B2 | 6/2012 | Alber et al. | |
| 8,331,592 | B2 | 12/2012 | Wu et al. | |
| 8,340,331 | B2 * | 12/2012 | Pansell | H04R 25/55 381/314 |
| 8,380,320 | B2 | 2/2013 | Spital | |
| 8,811,639 | B2 | 8/2014 | Solum et al. | |
| 2002/0030871 | A1 | 3/2002 | Anderson et al. | |
| 2002/0174340 | A1 | 11/2002 | Dick et al. | |
| 2003/0059073 | A1 | 3/2003 | Bren et al. | |
| 2003/0215106 | A1 | 11/2003 | Hagen et al. | |
| 2004/0052391 | A1 | 3/2004 | Bren et al. | |
| 2004/0193090 | A1 | 9/2004 | Lebel et al. | |
| 2004/0259585 | A1 | 12/2004 | Yitzchak et al. | |
| 2005/0100182 | A1 | 5/2005 | Sykes et al. | |
| 2005/0197061 | A1 | 9/2005 | Hundal | |
| 2005/0283263 | A1 | 12/2005 | Eaton et al. | |
| 2006/0039577 | A1 | 2/2006 | Sanguino et al. | |
| 2006/0274747 | A1 * | 12/2006 | Duchscher et al. | 370/389 |
| 2007/0269065 | A1 * | 11/2007 | Kilsgaard | H04R 25/554 381/315 |
| 2008/0175421 | A1 * | 7/2008 | Chizari | H04L 27/04 381/315 |
| 2008/0205664 | A1 * | 8/2008 | Kim | H04M 1/6066 381/77 |
| 2008/0260180 | A1 | 10/2008 | Goldstien et al. | |
| 2009/0058635 | A1 | 3/2009 | LaLonde et al. | |
| 2011/0090837 | A1 | 4/2011 | Duchscher et al. | |
| 2011/0150251 | A1 | 6/2011 | Solum et al. | |
| 2011/0150252 | A1 | 6/2011 | Solum et al. | |
| 2011/0150254 | A1 | 6/2011 | Solum et al. | |
| 2011/0249836 | A1 | 10/2011 | Solum et al. | |
| 2011/0249842 | A1 * | 10/2011 | Solum et al. | 381/315 |
| 2012/0310395 | A1 * | 12/2012 | El-Hoiydi | H04W 48/16 700/94 |
| 2013/0004002 | A1 | 1/2013 | Duchscher et al. | |

FOREIGN PATENT DOCUMENTS

| | | | |
|---|---|---|---|
| EP | 1519625 | A2 | 3/2005 |
| EP | 1980132 | B1 | 10/2008 |
| EP | 2012557 | A2 | 1/2009 |
| WO | WO-9641498 | A1 | 12/1996 |
| WO | WO-0209363 | A2 | 1/2002 |
| WO | WO-02061957 | A2 | 8/2002 |
| WO | WO-03008013 | A2 | 1/2003 |
| WO | WO-2005061048 | A1 | 7/2005 |
| WO | WO-2005101731 | A2 | 10/2005 |
| WO | WO-2006133158 | A1 | 12/2006 |
| WO | WO-2009076949 | A1 | 6/2009 |
| WO | WO-2010033731 | A1 | 3/2010 |

OTHER PUBLICATIONS

"U.S. Appl. No. 11/447,617, Non Final Office Action mailed Aug. 31, 2011", 29 pgs.
"U.S. Appl. No. 11/447,617, Non-Final Office Action mailed Jun. 22, 2009", 25 pgs.
"U.S. Appl. No. 11/447,617, Notice of Allowance mailed Mar. 16, 2012", 8 pgs.
"U.S. Appl. No. 11/447,617, Response filed Feb. 29, 2012 to Non Final Office Action mailed Aug. 31, 2011", 13 pgs.
"U.S. Appl. No. 11/447,617, Response filed May 26, 2009 to Restriction Requirement mailed Apr. 24, 2009", 8 pgs.
"U.S. Appl. No. 11/447,617, Response filed Aug. 3, 2010 to Final Office Action mailed Mar. 3, 2010", 14 pgs.
"U.S. Appl. No. 11/447,617, Response filed Nov. 23, 2009 to Non Final Office Action mailed Jun. 22, 2009", 15 pgs.
"U.S. Appl. No. 11/447,617, Restriction Requirement mailed Apr. 24, 2009", 6 pgs.
"U.S. Appl. No. 12/643,540, Advisory Action mailed Sep. 25, 2014", 4 pgs.
"U.S. Appl. No. 12/643,540, Advisory Action mailed Sep. 26, 2013", 2 pgs.
"U.S. Appl. No. 12/643,540, Final Office Action mailed Jun. 5, 2014", 17 pgs.
"U.S. Appl. No. 12/643,540, Final Office Action mailed Jun. 7, 2013", 13 pgs.
"U.S. Appl. No. 12/643,540, Final Office Action mailed Jul. 2, 2015", 22 pgs.
"U.S. Appl. No. 12/643,540, Non Final Office Action mailed Aug. 16, 2012", 14 pgs.
"U.S. Appl. No. 12/643,540, Non Final Office Action mailed Dec. 19, 2014", 17 pgs.
"U.S. Appl. No. 12/643,540, Non Final Office Action mailed Dec. 30, 2013", 15 pgs.
"U.S. Appl. No. 12/643,540, Response filed Jan. 16, 2013 to Non Final Office Action mailed Aug. 16, 2012", 8 pgs.
"U.S. Appl. No. 12/643,540, Response filed Mar. 31, 2014 to Non Final Office Action mailed Dec. 30, 2013", 7 pgs.
"U.S. Appl. No. 12/643,540, Response filed Apr. 20, 2015 to Non Final Office Action mailed Dec. 19, 2014", 8 pgs.
"U.S. Appl. No. 12/643,540, Response filed Sep. 5, 2014 to Final Office Action mailed Jun. 5, 2014", 8 pgs.
"U.S. Appl. No. 12/643,540, Response filed Sep. 6, 2013 to Final Officer Action mailed Jun. 7, 2013", 7 pgs.
"U.S. Appl. No. 12/830,892, Advisory Action mailed Sep. 15, 2014", 4 pgs.
"U.S. Appl. No. 12/830,892, Final Office Action mailed Apr. 1, 2013", 16 pgs.
"U.S. Appl. No. 12/830,892, Final Office Action mailed Jun. 13, 2014", 17 pgs.
"U.S. Appl. No. 12/830,892, Final Office Action mailed Jul. 6, 2015", 23 pgs.
"U.S. Appl. No. 12/830,892, Non Final Office Action mailed Jan. 29, 2015", 19 pgs.
"U.S. Appl. No. 12/830,892, Non Final Office Action mailed Aug. 17, 2012", 15 pgs.
"U.S. Appl. No. 12/830,892, Non Final Office Action mailed Dec. 20, 2013", 15 pgs.
"U.S. Appl. No. 12/830,892, Response filed Jan. 16, 2013 to Non Final Office Action mailed Aug. 17, 2012", 8 pgs.
"U.S. Appl. No. 12/830,892, Response filed Mar. 20, 2014 to Non Final Office Action mailed Dec. 20, 2013", 7 pgs.
"U.S. Appl. No. 12/830,892, Response filed Apr. 29, 2015 to Non Final Office Action mailed Jan. 29, 2015", 8 pgs.
"U.S. Appl. No. 12/830,892, Response filed Jul. 1, 2013 to Final Office Action mailed Apr. 1, 2013", 9 pgs.
"U.S. Appl. No. 12/830,892, Response filed Aug. 13, 2014 to Final Office Action mailed Jun. 13, 2014", 8 pgs.
"U.S. Appl. No. 12/980,696, Non Final Office Action mailed Apr. 20, 2011", 7 pgs.
"U.S. Appl. No. 12/981,108, Advisory Action mailed Jun. 4, 2015", 6 pgs.
"U.S. Appl. No. 12/981,108, Advisory Action mailed Oct. 1, 2013", 3 pgs.
"U.S. Appl. No. 12/981,108, Final Office Action mailed Jun. 6, 2013", 11 pgs.
"U.S. Appl. No. 12/981,108, Final Office Action mailed Dec. 19, 2014", 17 pgs.

(56) References Cited

OTHER PUBLICATIONS

"U.S. Appl. No. 12/981,108, Non Final Office Action mailed Apr. 3, 2014", 13 pgs.
"U.S. Appl. No. 12/981,108, Non Final Office Action mailed Jul. 6, 2015", 23 pgs.
"U.S. Appl. No. 12/981,108, Non Final Office Action mailed Aug. 17, 2012", 10 pgs.
"U.S. Appl. No. 12/981,108, Response filed Jan. 16, 2013 to Non Final Office Action mailed Aug. 17. 2012", 8 pgs.
"U.S. Appl. No. 12/981,108, Response filed Apr. 20, 2015 to Final Offfice Aciton mailed Dec. 19, 2014", 8 pgs.
"U.S. Appl. No. 12/981,108, Response filed Jun. 19, 2015 to Advisory Action mailed Jun. 4, 2015", 8 pgs.
"U.S. Appl. No. 12/981,108, Response filed Aug. 13, 2014 to Non Final Office Action mailed Apr. 3, 2014", 7 pgs.
"U.S. Appl. No. 12/981,108, Response filed Sep. 6, 2013 to Final Office Action mailed Jun. 6, 2013", 7 pgs.
"U.S. Appl. No. 13/084,988, Corrected Notice of Allowability mailed Jun. 4, 2014", 6 pgs.
"U.S. Appl. No. 13/084,988, Corrected Notice of Allowance mailed May 21, 2014", 5 pgs.
"U.S. Appl. No. 13/084,988, Corrected Notice of Allowance mailed Jul. 8, 2014", 6 pgs.
"U.S. Appl. No. 13/084,988, Non Final Office Action mailed Jan. 17, 2013", 12 pgs.
"U.S. Appl. No. 13/084,988, Non Final Office Action mailed Oct. 8, 2013", 11 pgs.
"U.S. Appl. No. 13/084,988, Notice of Allowance mailed Apr. 11, 2014", 11 pgs.
"U.S. Appl. No. 13/084,988, Response filed Jan. 8, 2014 to Non Final Office Action mailed Oct. 8, 2013", 9 pgs.
"U.S. Appl. No. 13/084,988, Response filed Jun. 17, 2013 to Non Final Office Action mailed Jan. 17, 2013", 8 pgs.
"U.S. Appl. No. 13/458,304, Non Final Office Action mailed Mar. 3, 2015", 9 pgs.
"U.S. Appl. No. 13/458,304, Response filed Jul. 6, 2015 to Non Final Office Action mailed Mar. 3, 2015", 7 pgs.
"Chinese Application Serial No. 200680028085.8, Office Action mailed Apr. 12, 2011", w/English translation, 3 pgs.
"Chinese Application Serial No. 200680028085.8, Office Action mailed Sep. 30, 2011", w/English translation, 8 pgs.
"European Application Serial No. 10252054.1, Extended Search Report mailed Sep. 14, 2012", 6 pgs.
"European Application Serial No. 06772250.4, Office Action mailed Dec. 22, 2010", 3 pgs.
"European Application Serial No. 06772250.4, Response filed Jun. 24, 2011 to Office Action mailed Dec. 22, 2010", 18 pgs.
"European Application Serial No. 10252054.1, Response filed Apr. 17, 2013 to Extended European Search Report mailed Sep. 14, 2012", 23 pgs.
"European Application Serial No. 11250442.8, Extended European Search Report mailed Aug. 18, 2011", 6 pgs.
"International Application Serial No. PCT/US2006/021870, International Preliminary Report on Patentability mailed Dec. 6, 2007", 8 pgs.
"International Application Serial No. PCT/US2006/021870, International Search Report and Written Opinion mailed Nov. 3, 2006", 13 pgs.

* cited by examiner

RANGE CONTROL FOR WIRELESS HEARING ASSISTANCE DEVICE SYSTEMS

CLAIM OF PRIORITY

This application claims the benefit of priority to and is a continuation of U.S. patent application Ser. No. 13/084,988, filed 12 Apr. 2011, which application claims the benefit under 35 U.S.C. 119(e) of U.S. Provisional Patent Application Ser. No. 61/323,560 filed Apr. 13, 2010, which applications are incorporated herein by reference in their entirety.

FIELD OF THE INVENTION

The present subject matter relates generally to wireless hearing assistance devices and in particular to a range control for wireless hearing assistance device systems.

BACKGROUND

Hearing assistance devices, such as hearing aids, typically include a signal processor in communication with a microphone and receiver. Such designs are adapted to perform a great deal of processing on sounds received by the microphone. More and more hearing assistance devices include a wireless communication option which provides a way to communicate with a hearing assistance device using another device. Such devices may have their own wireless protocols for communications or may use an industry standard protocol.

However, to be portable and power efficient wireless hearing assistance device designs must conserve the amount of time a device can transmit and receive data. In radio frequency environments with multiple signal sources a great deal of power can be wasted if the signals of interest are difficult to detect. Accordingly, there is a need in the art for apparatus and methods to provide improved wireless communications for wireless hearing assistance devices.

SUMMARY

Disclosed herein, among other things, are apparatus and methods to provide improved wireless communications for hearing assistance devices and hearing assistance device applications. Also, disclosed herein, among other things, are apparatus and methods for wireless hearing assistance devices and in particular to a controllable range control for wireless hearing assistance device systems. In various embodiments, an advertisement is used to allow the receiver to quickly receive streaming information, thus conserving power.

In various embodiments, a system for communications with a hearing assistance device includes a wireless streaming device having a range control. The range control is configured to provide a first range for an advertisement transmission and a second range for a streaming information transmission. The first range is less than the second range, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Modern hearing instruments capable of wireless communication have a limited power budget and must remain in a sleep wake cycle to conserve power due to the limited battery capacity available to a small hearing instrument worn in or on the ear. Because of this the aid must spend as little time in the "receive on" state as possible.

Figure 1:
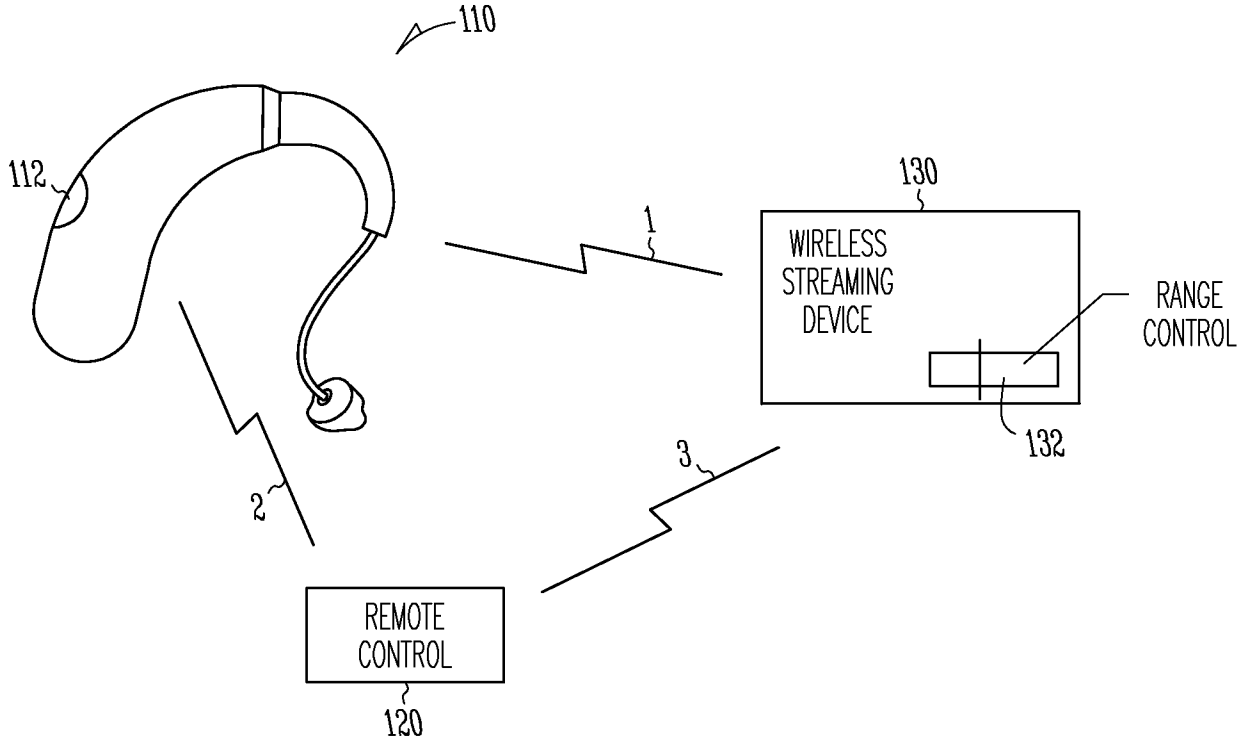
FIG. 1 shows a hearing assistance device with a control, a wireless remote control, and a wireless streaming device with a range control according to one embodiment of the present subject matter.

FIG. 1 shows a hearing assistance device 110 with a control 112, a wireless remote control 120, and a wireless streaming device 130 with a range control 132 according to one embodiment of the present subject matter. The wireless communication paths include one or more of: path 1 between the hearing assistance device 110 and the streaming device 130; path 2 between the hearing assistance device 110 and the remote control 120; and/or path 3 between the remote control 120 and the wireless streaming device 130. It is understood that the wireless communication can be unidirectional or bidirectional. It is further understood that any wireless hearing assistance device may be used without departing from the scope and the devices depicted in the figures are intended to demonstrate the subject matter, but not in a limited, exhaustive, or exclusive sense.

One aspect of the present subject matter is to use a well known channel to "advertise" the channel, frequency, timeslot, or code needed for demodulation of the signal. This advertisement in various embodiments includes any code necessary for decoding the data. In one embodiment the advertisement includes CODEC data. In one embodiment, the information in the advertisement is any necessary information to receive and decode the local wireless audio stream from the wireless streaming device. In various embodiments, the wireless audio stream is mono, stereo with one of the right or left channels, or stereo with both the right and left channels. Other information is possible without departing from the scope of the present subject matter. Thus, the advertisement contains the information needed to acquire the stream signal or signals rapidly.

By using a well known frequency or frequencies the hearing instrument can wake up and look for a signal such as an advertisement signal that can tell the aid on which channel, timeslots, or codes such as a frequency hopping codes or PN sequences for a direct sequence spread spectrum signal (or signals) that is currently available with a streaming wireless audio signal. Hearing no such advertisement the aid can go back to sleep immediately to conserve power.

Upon hearing the advertisement, the aid can acquire the streams quickly and automatically whenever it is within range of the device sending the streams and the advertisements. In various embodiments, the advertisement signal is sent with a lower symbol rate or greater redundancy (multiple times) or greater overhead with the addition of forward error correction (FEC) to improve the link probability on a channel that may not necessarily be the best possible for use but that is well known to both the hearing instrument and the advertiser. The streamed channels can be selected by the host device based on quality as measured by the amount of interference on a potential set of channels that may be shared with other unlicensed devices. For this reason the channels used for streaming can use a higher data rate with less redundancy than the advertisement channels.

Figure 2:
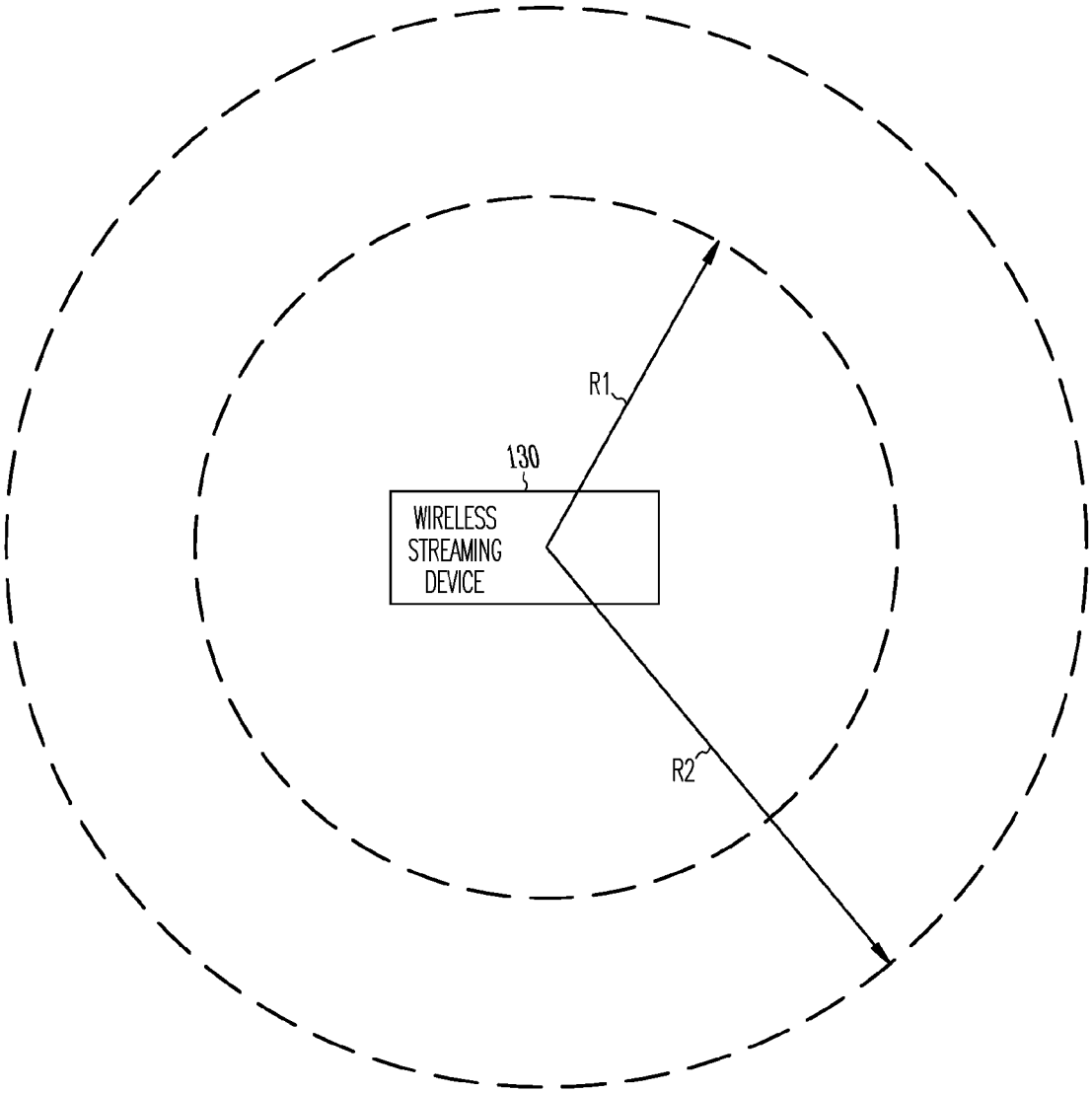
FIG. 2 shows a wireless streaming device with a first range for an advertisement and a second range for the streaming wireless information according to one embodiment of the present subject matter.

In various embodiments the system will reduce the power and thus the link margin on the advertised channels when compared with the streamed channels to allow for a certain amount of hysteresis when acquiring and maintaining the stream. The user may not want to acquire a stream that is near the outer limit of range which may be prone to errors and loss of signal. Instead you may want to lower the power of the advertisement such that the user is well within the operating range of the stream signal to ensure good quality signals (low BER and low PER). Once acquired however the desired stream signal will have sufficient power to maintain a quality link even if the user goes out of range of the advertisement signal. This is demonstrated in FIG. 2 which shows a wireless streaming device with a first range R1 for an advertisement and a second range R2 for the streaming wireless information according to one embodiment of the present subject matter.

Figure 3:
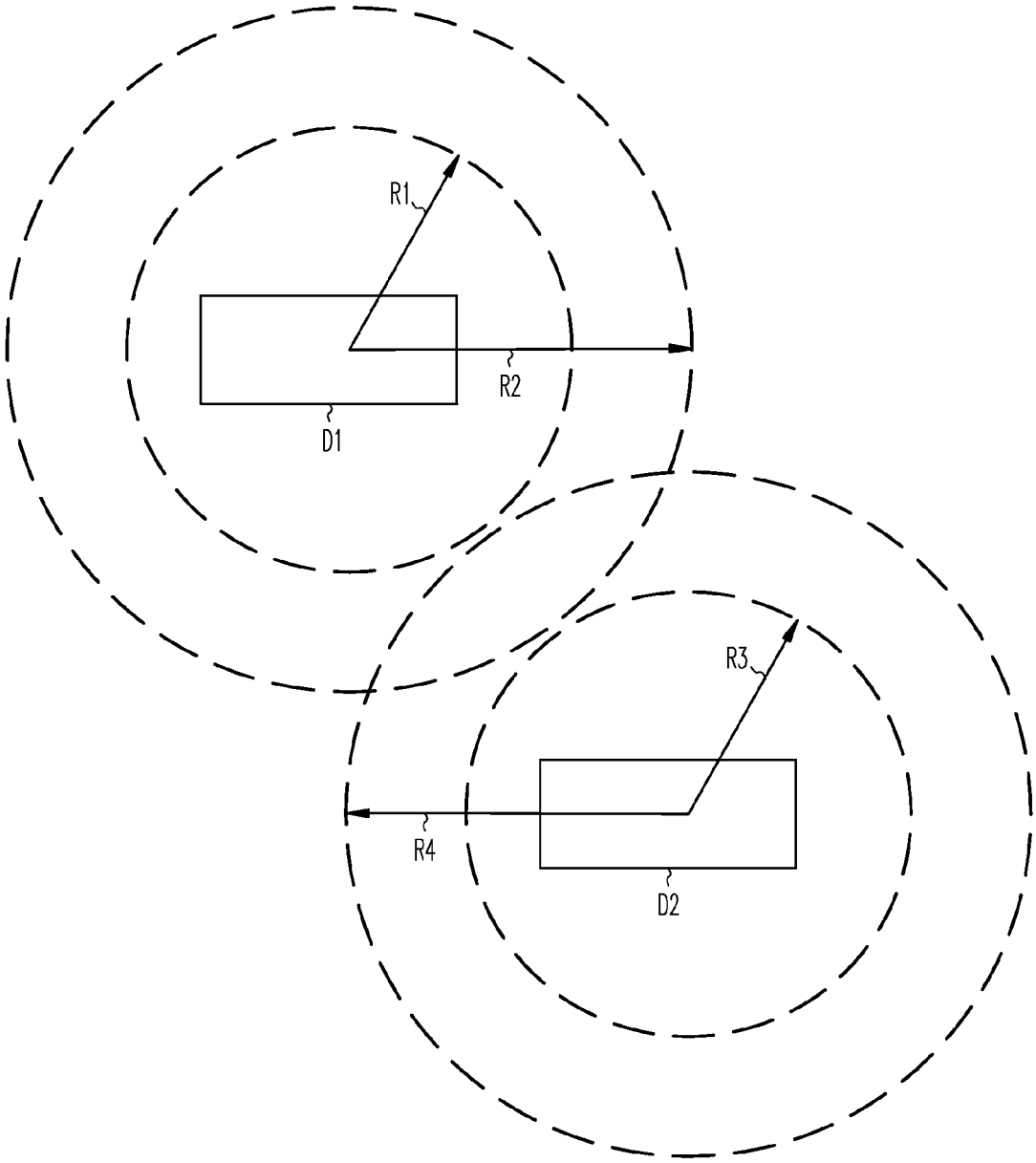
FIG. 3 shows a first wireless streaming device with a first range for its advertisement and a second range for its streaming wireless information and a second wireless streaming device with a third range for its advertisement and a fourth range for its streaming wireless information according to one embodiment of the present subject matter.

This will also allow the use of multiple streaming devices within range of one another without the user accidentally picking up a signal unless they are in close proximity to one of the streaming devices. This will allow a user in a multi-dwelling complex to avoid picking up unwanted signals from another user's streamer or from another room within the same home if the user has multiple streamers within the same dwelling. This is demonstrated in FIG. 3 which shows a first wireless streaming device (D1) with a first range R1 for its advertisement and a second range R2 for its streaming wireless information and a second wireless streaming device (D2) with a third range R3 for its advertisement and a fourth range R4 for its streaming wireless information according to one embodiment of the present subject matter.

In various embodiments, the range control 132 of the wireless streaming device 130 can be used to adjust the range of the advertisement. In various embodiments the range can be adjusted by a remote control, such as remote control 120. In various embodiments, the range control can be adjusted by hearing assistance device 110. Other range adjustments can be made using these and other devices.

In one embodiment, the scanning for a streaming channel, timeslot or code is initiated upon a button press. In one embodiment, the scanning is performed by operating the control 112 on hearing assistance device 110. In one embodiment, the scanning for a streaming channel, timeslot or code is initiated upon receipt of a message. In one embodiment, the scanning for a streaming channel, timeslot or code is initiated upon receipt of a voice command. In one embodiment, the scanning for a streaming channel, timeslot or code is initiated upon receipt of a proper dual tone multifunction (DTMF) audio command. Other types of commands may be used without departing from the scope of the present subject matter.

The channel scanning in various embodiments includes, but is not limited to, simple frequency scanning, time slot scanning, hop sequence determination for FHSS, PN code acquisition for DSSS signal acquisition, or combinations of the foregoing.

In various embodiments, a DTMF pair of tones or a sequence of DTMF tones are used to place a hearing instrument or instruments in a scanning mode of operation to attempt to acquire a stream message.

In various embodiments, a message from wireless remote control 120 is used to instruct the hearing assistance device 110 to begin scanning for a streaming audio channel. In various embodiments, the wireless remote control 120 can also send messages to the hearing aid 110 via the wireless streaming device 130. In various embodiments the remote control 120 can adjust the range of the wireless streaming device 130. In various embodiments, the remote control 120 can adjust the range of the advertisement coming from the wireless streaming device 130. Other applications are possible without departing from the scope of the present subject matter.

In various embodiments control 112 of hearing assistance device 110 is used to place the hearing assistance device 110 in a scanning mode of operation.

In various embodiments mono streams are employed. In various embodiments stereo streams are used. In various embodiments hybrid mono and stereo streams are used.

The following commonly owned patent documents are hereby incorporated by reference in their entirety: U.S. patent application Ser. No. 12/643,540, filed Dec. 21, 2009, titled LOW POWER INTERMITTENT MESSAGING FOR HEARING ASSISTANCE DEVICES; U.S. Patent Application Ser. No. 60/687,707 filed Jun. 5, 2005, titled COMMUNICATION SYSTEM FOR WIRELESS AUDIO DEVICES; and U.S. patent application Ser. No. 11/447,617, titled COMMUNICATION SYSTEM FOR WIRELESS AUDIO DEVICES.

The present subject matter can be used for a variety of hearing assistance devices, including but not limited to, assistive listening devices, tinnitus masking devices, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system, comprising:

a wireless streaming device;

a hearing assistance device including a wireless communication receiver configured to receive an advertisement radio frequency transmission from the streaming device and configured to receive a streaming information radio frequency transmission from the streaming device, wherein the hearing assistance device is configured to wake up and scan for the advertisement transmission on a specified channel; and wherein the wireless streaming device includes a range control configured to provide a first range for the advertisement transmission and a second range for the streaming information transmission, and wherein the second range of the streaming information transmission is greater than the first range of the advertisement transmission, and wherein the advertisement transmission includes information regarding a channel, frequency, timeslot, or code for demodulation of the streaming information transmission.

2. The system of claim 1, wherein the advertisement is adapted to automatically provide information to the hearing assistance device, to allow the hearing assistance device to automatically acquire the streaming information transmission.

3. The system of claim 1, further comprising a remote control configured to communicate with the wireless streaming device to control the ranges of the transmissions.

4. The system of claim 3, wherein the remote control is configured to send a message to instruct the hearing assistance device to begin scanning for a streaming audio channel.

5. The system of claim 3, wherein the remote control is configured to send messages to the hearing assistance device via the wireless streaming device.

6. The system of claim 1, wherein the hearing assistance device is configured to communicate with the wireless streaming device to control the ranges of the transmissions.

7. The system of claim 1, wherein the hearing assistance device is configured to go back to sleep if not within the first range and unable to receive the advertisement transmission.

8. The system of claim 1, wherein the advertisement transmission includes CODEC data.

9. The system of claim 1, wherein streaming information transmission channels use a higher data rate with less redundancy than advertisement transmission channels.

10. The system of claim 1, wherein the streaming information transmission includes mono streams, stereo streams or hybrid mono and stereo streams.

11. The system of claim 1, wherein the hearing assistance device includes a behind-the-ear (BTE) hearing aid.

12. The system of claim 1, wherein the hearing assistance device includes an in-the-ear (ITE) hearing aid.

13. A method of using a hearing assistance device, the method comprising:

receiving an advertisement radio frequency transmission if within a first range from a wireless radio frequency streaming device, including receiving a message to instruct the hearing assistance device to begin scanning for the advertisement transmission on a streaming audio channel, including scanning for a streaming channel frequency, timeslot or code; and receiving a streaming information radio frequency transmission if within the first range from the wireless radio frequency streaming device after receiving the advertisement transmission, wherein a second range of the streaming information transmission is greater than the first range, wherein providing the first range and the second range includes using a range control included with the wireless streaming device.

14. The method of claim 13, wherein receiving the message includes receiving a voice command, pressing a button control, or sending a dual tone multifunction (DTMF) audio command.

15. The method of claim 13, wherein scanning for a streaming audio channel includes hop sequence determination for frequency hopping spread spectrum (FHSS) signal acquisition or pseudo-noise (PN) code acquisition for direct sequence spread spectrum (DSSS) signal acquisition.

16. The method of claim 13, wherein the advertisement transmission is adapted to automatically provide information to the hearing assistance device, to allow the hearing assistance device to automatically acquire the information transmission.

* * * * *